United States Patent [19]

Sugiyama et al.

[11] Patent Number: 4,715,121

[45] Date of Patent: Dec. 29, 1987

[54] GRIP SCISSORS

[75] Inventors: Makoto Sugiyama; Hiroshi Sugimura; Naoyoshi Machida; Yoshiichi Murai, all of Seki, Japan

[73] Assignee: Kai Cutlery Center Co., Ltd., Seki, Japan

[21] Appl. No.: 810,919

[22] Filed: Dec. 18, 1985

[30] Foreign Application Priority Data

Sep. 19, 1985 [JP] Japan ..... 60-142968[U]

[51] Int. Cl.[4] ..... B26B 13/00

[52] U.S. Cl. ..... 30/253; 30/162

[58] Field of Search ..... 30/143, 152, 154, 155, 30/162, 163, 233, 244, 245, 253

[56] References Cited

U.S. PATENT DOCUMENTS

| | | | |
|---|---|---|---|
| 903,370 | 11/1908 | Frey | 30/253 |
| 1,299,104 | 4/1919 | Arnold | 30/253 |
| 1,507,043 | 9/1924 | Blow | 30/162 X |
| 1,960,130 | 5/1934 | Trubel | 30/162 X |
| 4,089,113 | 5/1978 | Moritz et al. | 30/253 |
| 4,092,776 | 6/1978 | Ferguson | 30/253 |
| 4,502,220 | 3/1985 | Aoki | 30/162 X |

*Primary Examiner*—Paul A. Bell
*Assistant Examiner*—Michael D. Folkerts
*Attorney, Agent, or Firm*—Stephen G. Rudisill

[57] ABSTRACT

A pair of grip scissors is provided which comprises a grip scissor body having a pair of mutually open/closeable scissor segments, a housing case capable of housing therein the grip scissor body movably in the lengthwise direction thereof and of projecting the grip scissor body outward, at least one slide groove formed in the housing case and extending in the lengthwise direction thereof, and a slider coupled to the grip scissor body and movable reciprocatingly along the slide groove of the housing case.

14 Claims, 29 Drawing Figures

GRIP SCISSORS

BACKGROUND OF THE INVENTION

1. Field of the Invention

This invention relates to grip scissors with a housing case which are retractable with respect to the housing case.

2. Description of the Prior Art

Conventional grip scissors are comparatively short; thus, the user feels often instability when one holds the scissors and it is not easy for one unaccustomed to use the scissors. Further, conventional grip scissors are not provided with a housing case coupled integrally to their scissor body; thus, cutting edges are normally exposed thereby giving rise to danger.

SUMMARY OF THE INVENTION

It is a general object of the present invention to provide a pair of grip scissors which is easy to grasp when in use and can be kept in a safety state when not in use by putting back a grip scissor body into a housing case.

It is another object of the present invention to provide a pair of grip scissors whose scissor body can easily be locked up with respect to a housing case in a housed state and projected state.

It is still another object of the present invention to provide a pair of grip scissors which can be made into a single unit by forming it by a pair of scissor segments, a coupling section for coupling together the pair of scissor segments, and a slider, whereby these parts can easily be assembled into a housing case and are not in danger of being lost.

To achieve the foregoing objects, the present invention provides a pair of grip scissors which comprises a grip scissor body having a pair of mutually open/closeable scissor segments, a housing case capable of housing therein the grip scissor body movably in the lengthwise direction thereof and of projecting the grip scissor body outward, at least one slide groove formed in the housing case and extending in the lengthwise direction thereof, and a slider coupled to the grip scissor body and movable reciprocatingly along the slide groove of the housing case.

Other objects of the present invention will become apparent upon an understanding of embodiments hereinafter described and will be indicated in the appended claims. Various advantages not referred to herein will occur to those skilled in the art upon practicing the present invention.

DETAILED DESCRIPTION OF THE PREFERRED EMBODIMENTS

The first embodiment of the present invention will now be described with reference to FIGS. 1 through 4.

Figure 1:
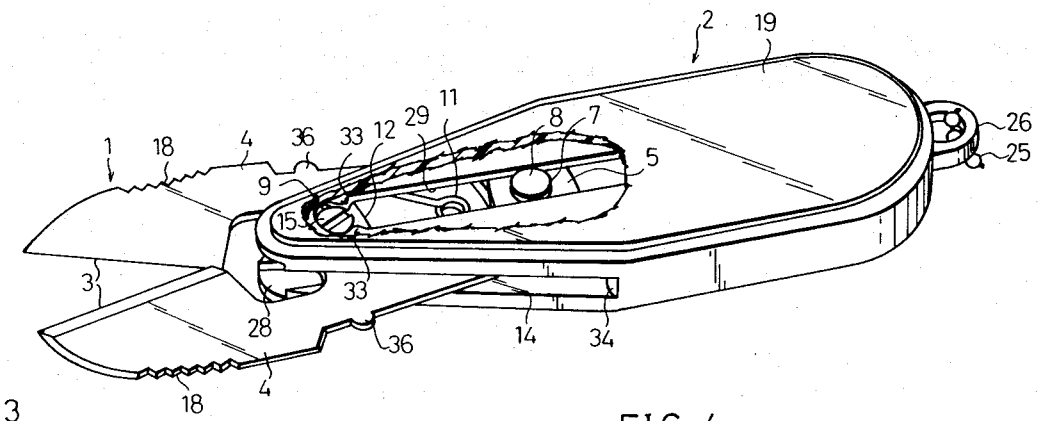
FIG. 1 is a perspective view showing a pair of grip scissors in the serviceable state, with portions broken away, which is a first embodiment of the present invention.
Figure 2:
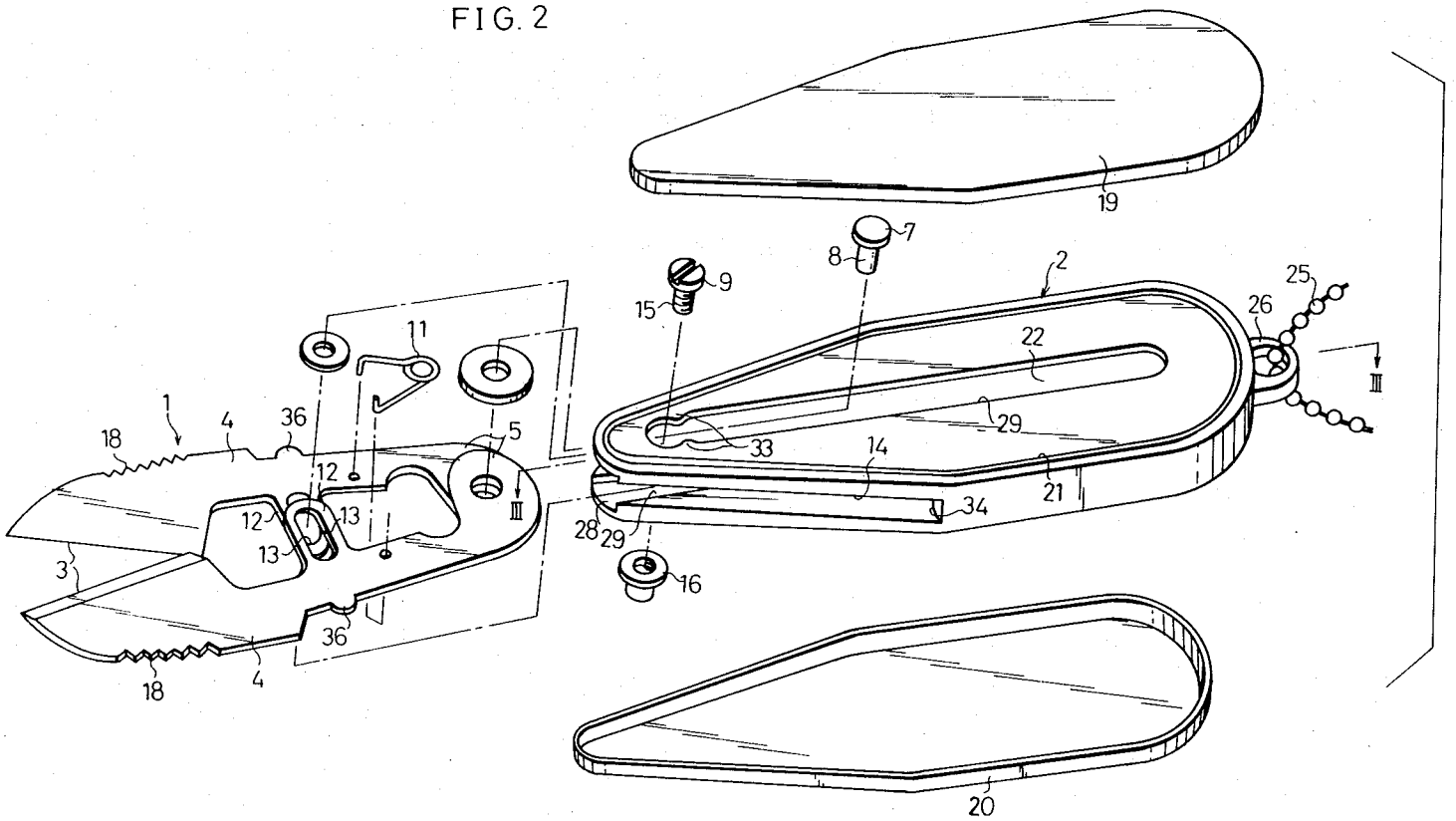
FIG. 2 is an exploded perspective view of FIG. 1.

As shown in FIG. 1, a pair of grip scissors of the first embodiment comprises a grip scissor body 1 and a housing case 2 molded from synthetic resin. As shown in FIG. 2, the grip scissor body 1 is composed of a pair of scissor segments 4 each formed with a cutting edge 3 along the inner margin of its tip section, with base end coupling portions 5 of these scissor segments being coupled together pivotably so that they can open and close mutually by means of a pin 8 having a large-diameter head 7 serving as a guide projection.

Between the middle portions of respective scissor segments 4 a spring 11 is interposed, by the elastic strength of which both scissor segments 4 are urged in their respective opening directions. The inner marginal face in the center section of each scissor segment 4 has a projection segment 12 which is put upon the same of the opposite scissor segment 4, these projection segments 12 having slots 13 of the same shape and size. Into both slots 13 a locking screw 15 having a head 9 which serves as a slider is inserted and clamped by a nut 16 screwed on its lower end. In these drawings, reference numeral 18 indicates a saw tooth-like finger touch portion formed on the outer margin of the tip section of each scissor segment 4.

Figure 3:
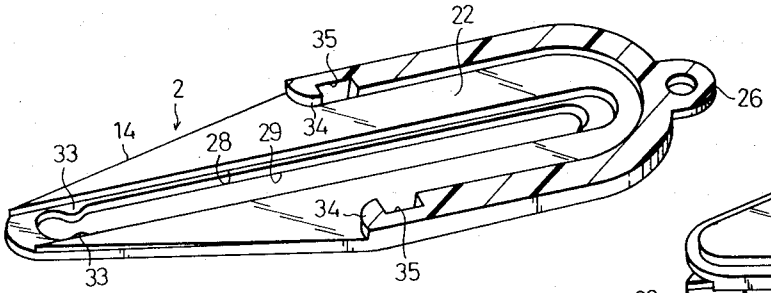
FIG. 3 is a sectional view taken along line III—III of FIG. 2.

The housing case 2 is made in such a shape that it becomes slenderer with approaching its tip so as to be grasped by the hand. As shown in FIG. 3, on the inner rear side of the housing case 2 a housing section 22 is formed for housing the grip scissor body 1 therein slidably in the in and out direction, and its front section has an opening 14 through which the grip scissor body 1 can go in and out. The front inner surface of the housing section 22 has a pair of closure attaining faces 34 which, when the grip scissor body 1 is to be housed in, come into contact with the outer surfaces of both scissor segments 4 and cause both scissor segments 4 to move in their respective closing directions. The base end surface of the housing case 2 has a chain attaching ring 26 formed integrally thereon to which a chain 25 for carrying the scissors is coupled.

In the inner upper and lower surfaces of the housing section 22 recesses 28 are formed respectively which extend in the lengthwise direction of the housing case 2, and in each recess 28 a slide groove 29 is bored which extends therealong. In these slide grooves 29 are fitted the head 7 of pin 8, the head 9 of screw 15, and the nut 16 of the grip scissor body 1, so that by the slider made up of these members the grip scissor body 1 is guided slidably in the in and out direction. The slide groove 29 has a pair of restricting convex portions 33 formed on its front inner surface, so that as shown in FIG. 1, through engagement of these restricting convex portions 33 with the head 9 of screw 15, the movement in the housing direction of the grip scissor body 1 being in the projected/serviceable state is restricted.

Figure 4:
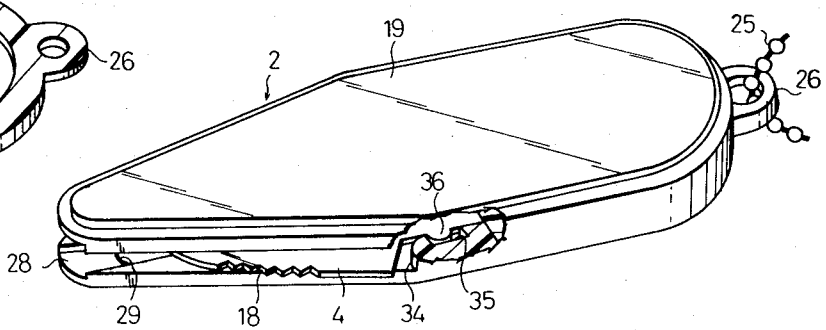
FIG. 4 is a perspective view, with portions broken away, showing the grip scissors in the nonuse state of FIG. 1.

As shown in FIG. 3, in the inner surface of the housing section 22 a pair of locking concave portions 35 are formed which are contiguous to the closure attaining faces 34. As shown in FIG. 4, when the grip scissor body 1 is moved to be housed in, a pair of locking convex portions 36 formed projectingly on the outer margins of the scissor segments 4 are guided by the closure attaining faces or cam faces 34 and locked by the locking concave portions 35. Reference numerals 19 and 20 shown in FIG. 2 indicate two cap plates to be fitted in and secured by respective fitting grooves 21 formed in the upper and lower surfaces of the housing case 2.

FIG. 4 illustrates the housed state where the grip scissor body 1 is housed in the housing section 22 of the housing case 2, with only portions around the finger touch portions 18 of both scissor segments 4 exposed outside the housing case 2. In the above state, if both finger touch portions 18 are grasped so that both scissor segments 4 are pressed in their closing directions in opposition to the elastic strength of the spring 11, the engagement of the locking concave portions 35 of the housing case 2 with the locking convex portions 36 of the grip scissor body 1 is removed. Accordingly, if both scissor segments 4 are pulled out under the above state, the grip scissor body 1 moves and projects into the serviceable state illustrated in FIG. 1 while the head 7 of pin 8, the head 9 of locking screw 15, and the nut 16 are guided by both slide grooves 29. Then, due to the elastic strength of the spring 11 the scissor segments 4 are opened, and the head 9 of screw 15 comes into engagement with the restricting convex portions 33 of the slide groove 29, whereby the grip scissor body 1 is maintained in the serviceable state.

Because in this serviceable state the finger tip of the user touches exactly the finger touch portion 18 of each scissor segment 4 when the housing case 2 is grasped by the hand, the housing case 2 serves as the hilt of the grip scissor body 1 and the cutting work at the time of use done by the cutting edges 3 can be achieved under stable conditions. In addition, because the grip scissor body 1 of this first embodiment is supported by the housing case 2 at two points, i.e. by the head 7 of pin 8 and the head 9 of screw 15, there is no fear that the grip scissor body 1 will turn relatively with respect to the housing case 2 when in use.

At the time of housing the grip scissor body 1 being in the serviceable state, both scissor segments 4 are pushed into the housing case while grasping the finger touch portions 18, as a result, the engagement of the head 9 of screw 15 with the restricting convex portions 33 is removed and the grip scissor body 1 is moved into the housing section 22 of the housing case 2 while being guided by the slide grooves 29. Consequently, the locking convex portions 36 of both scissor segments 4 come into contact with the closure attaining surfaces 34 of the housing section 22, both scissor segments 4 are moved in their respective closing directions in opposition to the elastic strength of the spring 11, and the locking convex portions 36 are fitted in and locked by the locking concave portions 35, as shown in FIG. 4.

Therefore, in the housed state the cutting edges 3 of the scissor segments 4 are kept in the closed state and housed completely inside the housing section 22 of the housing case 2; thus, safety is secured when not in use, in different to the conventional scissors. In addition, owing to the engagement of the locking concave portions 35 with the locking convex portions 36, unexpected projecting of the grip scissor body 1 is prevented surely; thus, the present grip scissors can be carried safely, for example, while putting it in a pocket.

Figure 5:
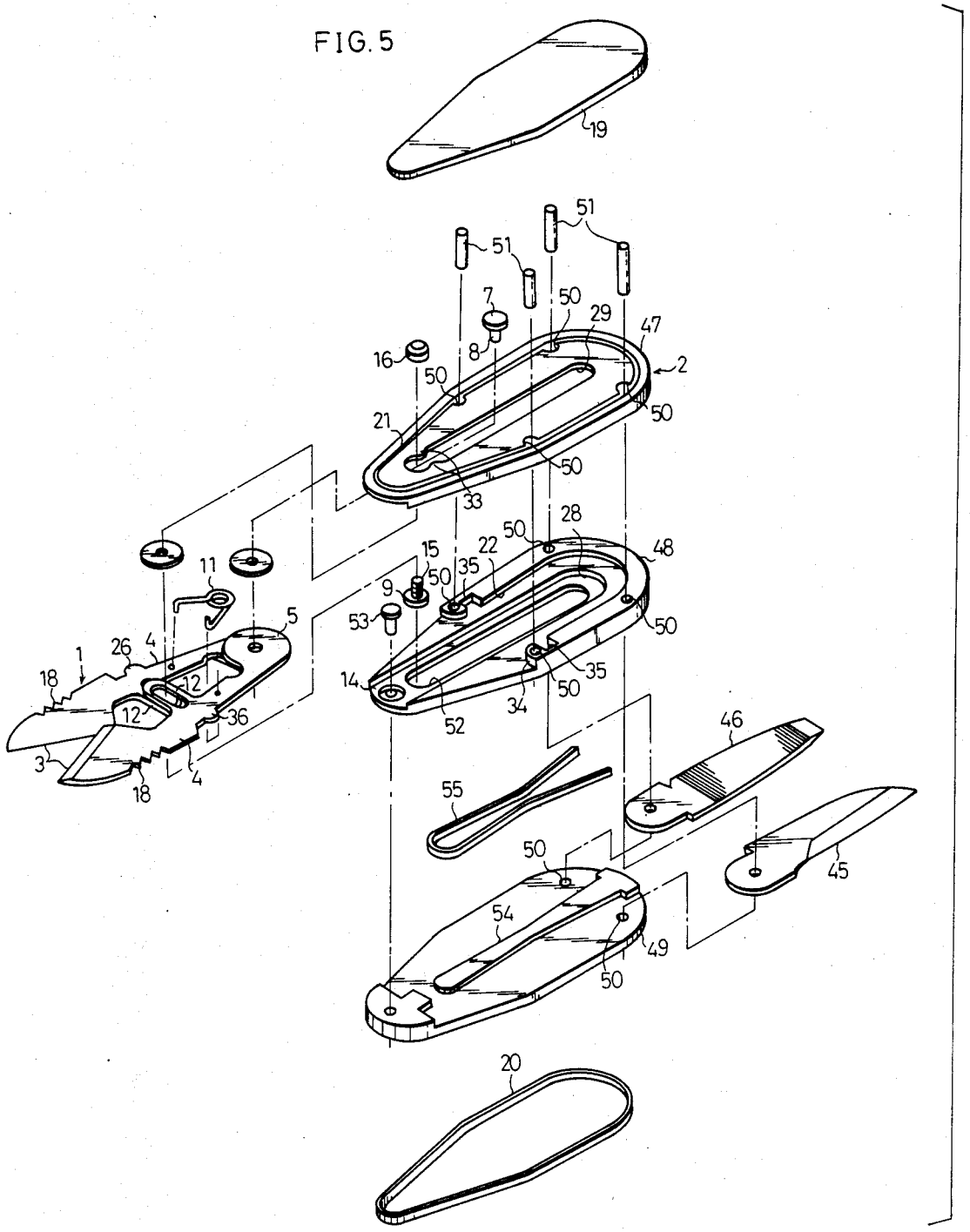
FIG. 5 is an exploded perspective view showing a pair of grip scissors for fishing which is a second embodiment of the present invention.

The second embodiment of the present invention which is realized in the form of a pair of grip scissors for fishing will now be described with reference to FIG. 5. This second embodiment differs from the foregoing first embodiment in that in the housing case 2 of this embodiment a knife 45 and a file 46 for polishing a fishhook are assembled integrally in addition to the scissor body 1.

Describing only the configuration of this second embodiment differing from the first embodiment (in the drawings, like reference numerals designate like or corresponding parts), the housing case 2 is divided into three parts: an upper plate 47, middle plate 48, and lower plate 49, and these plates are piled one upon another and secured together by coupling pins 51 inserted into a plurality of thru-holes 50 bored in peripheral portions of the rear half section of each plate. Further, in this embodiment, the middle plate 48 has a guide concave portion 52 formed in opposition to the slide groove 29 of the upper plate 47, and in the guide concave portion 52 and slide groove 29 are fitted the head 9 of screw 15, the nut 16, the head 7 of pin 8, and the lower caulking portion (not shown) of pin 8, whereby the foregoing slide members of the grip scissor body 1 are guided. Reference numeral 53 indicates a headed pin for coupling together the middle plate 48 and lower plate 49 at their front ends.

To the pair of coupling pins 51 on the rear side coupled between the middle plate 48 and lower plate 49 the knife 45 and file 46 are assembled respectively and pivotably. When not in use the knife 45 and file 46 are housed respectively inside the housing case 2, and their base end portions abut on the outer faces of either tip of a U-shaped leaf spring 55 fitted around a block convex portion 54 extending at the center of the lower plate 49 in its lengthwise direction, whereby the knife and file are maintained in the housed state while receiving the spring action.

Accordingly, if one carries the thus configured scissors with him at the time of fishing, similarly to the first embodiment, the cutting edges 3 of the grip scissor body 1 of this second embodiment are not exposed in the housed state, thus are safe when not in use. Moreover, because the knife 45 and file 46 are assembled integrally together with the grip scissor body 1, the use of this type is expanded more and it can be used more conveniently.

Modifications of the first and second embodiments will now be described with reference to FIGS. 6 through 8.

Figure 6:
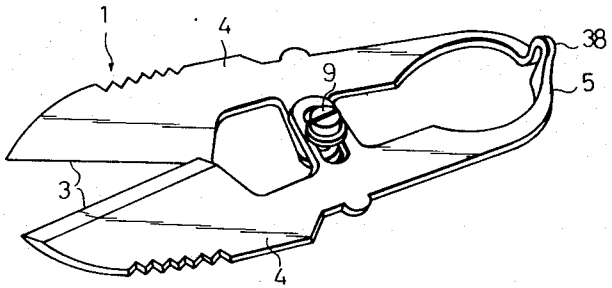
FIG. 6 is a perspective view of a grip scissor body which is a modification of the first and second embodiments of the present invention.

(1) As shown in FIG. 6, the scissor segments 4 of the grip scissor body 1 are connected integrally together at their base end coupling portions 5 into a single unit, the thus connected coupling section 5 is bent into the shape of U so as to possess the spring function, and the U-shaped bent section being referred to as a guide projection 38 is fitted in the slide groove 29 of the housing case 2. According to the foregoing modified construction, the spring 11 of the foregoing embodiments becomes unnecessary, the number of parts is reduced, and the assembly work becomes easy. In this modification, instead of providing the guide projection 38 the coupling portions 5 of both scissor segments 4 may be made flat.

Figure 7:
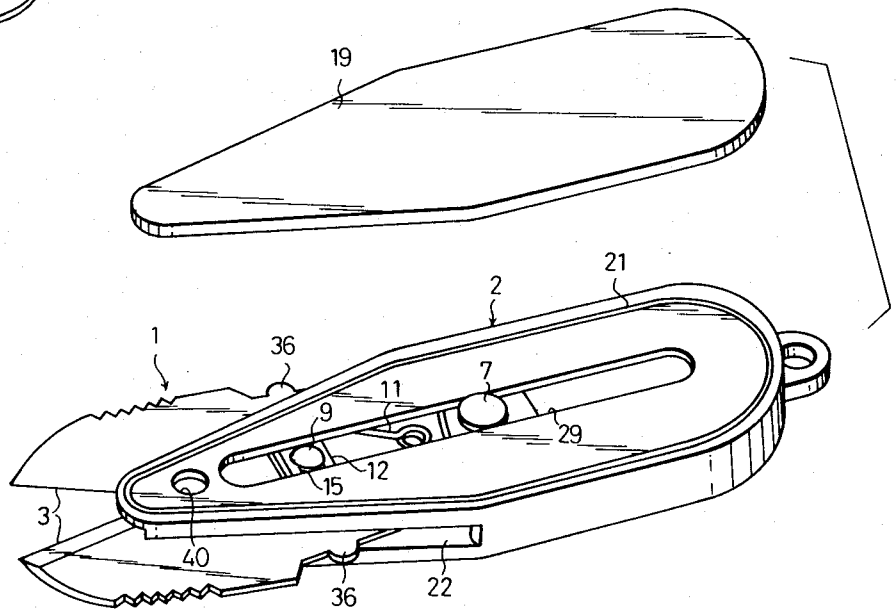
FIG. 7 is a perspective view of a pair of grip scissors, partly in exploded view, which is another modification.

(2) As shown in FIG. 7, the head 9 of screw 15 employed in the first and second embodiments is made semi-spherical, and a restricting hole 40 is bored ahead of the slide groove 29 in the housing case 2, in which the thus shaped head 9 is fitted and locked thereby. According to this modification, similarly to the restricting convex portions 33 of both embodiments, the restricting hole 40 can prevent retractive movement of the grip scissor body 1 when in use.

Figure 8:
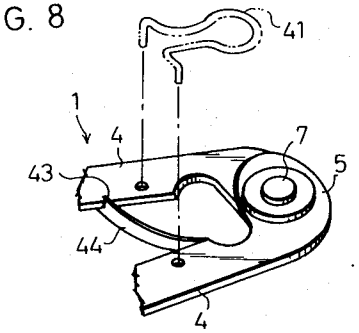
FIG. 8 is a perspective view showing modifications of a spring.
Figure 9:
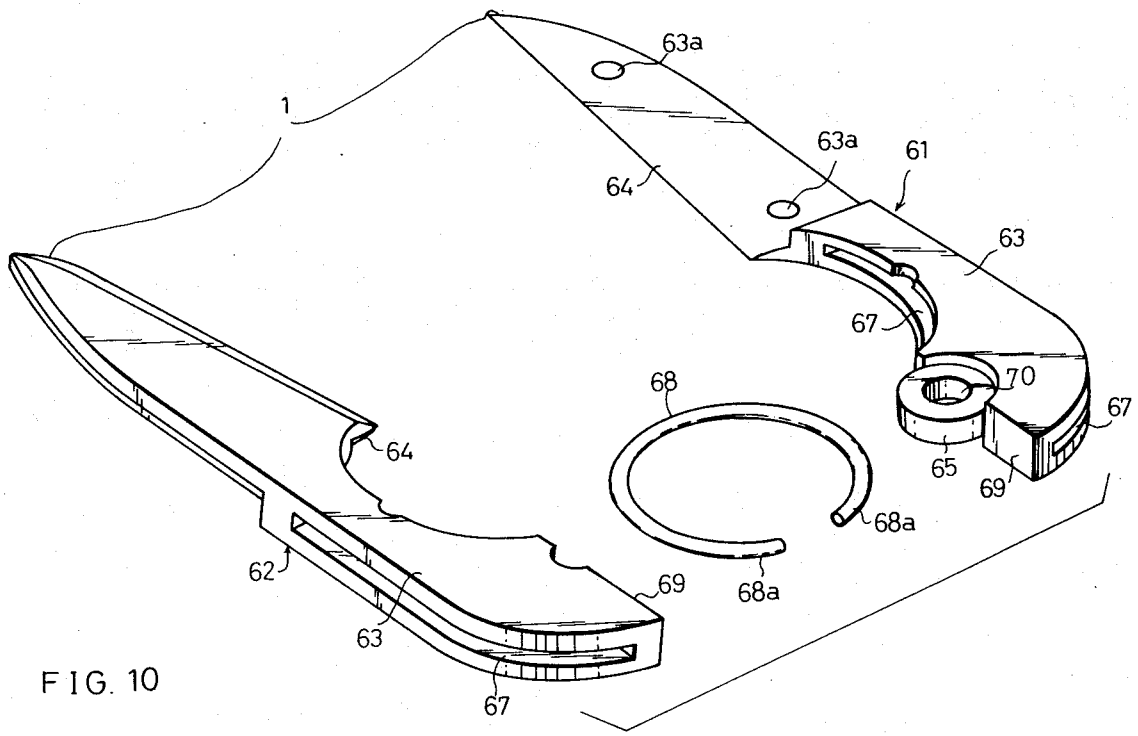
FIG. 9 is an exploded perspective view of a grip scissor body which is a third embodiment of the present invention.
Figure 10:
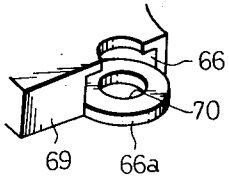
FIG. 10 is a perspective view of a part of one scissor segment of FIG. 9.

(3) As illustrated by the chain line in FIG. 8, in place of the spring 11 of the foregoing embodiments, a substantially U-shaped wire spring 41 is employed.

(4) As illustrated by the solid line also in FIG. 8, a locking slit 43 is formed in the inner surface of one of the scissor segments 4, to which a leaf spring 44 is coupled whose tip is made to abut on the inner surface of the other scissor segment 4.

(5) The relation between the locking concave portion 35 and locking convex portion 36 of the foregoing embodiments is reversed, that is, locking concave portions are formed in the outer surfaces of both scissor segments 4 and locking convex portions are formed on the inner surface of the housing case 2.

(6) In place of the slide groove 29 of the foregoing embodiments, a guide means for guiding the slide members of the grip scissor body 1 is provided and made in the form of a concave groove in which the head 7 of pin 8 and the head 9 of screw 15 can be fitted.

The third embodiment of the present invention which is realized in the form of a pair of grip scissors with a case will now be described with reference to FIGS. 9 through 16.

In these drawings, reference numerals 61 and 62 indicate a pair of scissor segments of the grip scissors of this third embodiment. Each scissor segment 61, 62 is composed of a scissor segment body 63 made of plastic and a metallic blade 64 secured by a plurality of caulking projections **63*a* projecting on the scissor segment body 63. By both scissor segments 61 and 62 the grip scissor body 1** is made up.

Figure 11:
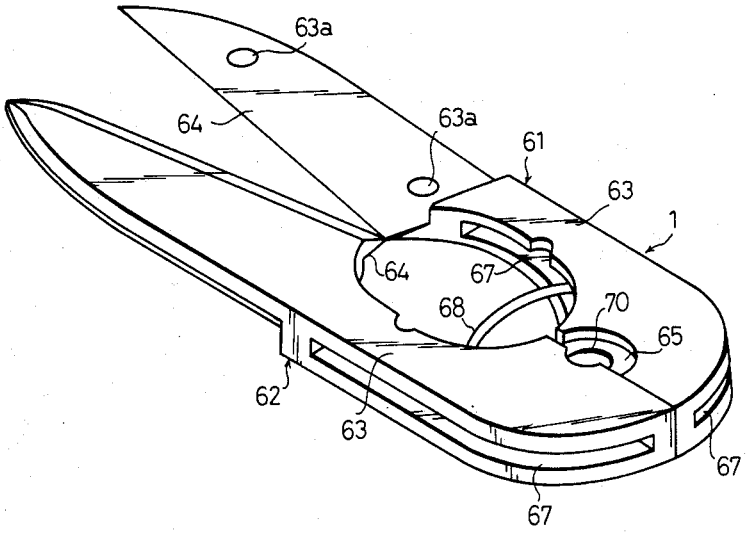
FIG. 11 is a perspective view of the grip scissor body assembled of FIG. 9.
Figure 12:
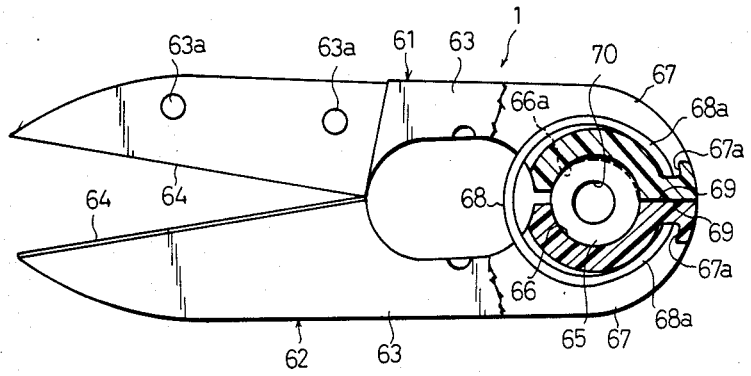
FIG. 12 is a plan view of FIG. 11 with portions broken away.

Reference numeral 65 indicates a convex portion formed on the inner surface of the base end section of the scissor segment body 63 of one scissor segment 61, and 66 is a concave portion formed in the inner surface of the base end section of the scissor segment body 63 of the other scissor segment 62. The convex portion 65 is placed on a receiving portion **66*a* of the concave portion 66 so that these convex and concave portions 66 and 65 are coupled and fitted together to form a support section, as shown in FIGS. 11 and 12. Reference numeral 67 indicates a mounting groove formed in the base end section of the scissor segment body 63 of each scissor segment 61, 62 so as to surround the support section, 65 and 66**.

Reference numeral 68 indicates a ring spring with a part cut off, which is inserted from a position ahead of the support section, 65 and 66 into the mounting grooves 67 so as to surround the support section, 65 and 66. Either end **68*a* of the ring spring 68 is locked in a locking portion 67*a*, located closer to the base end than the support section, 65 and 66, of the mounting groove 67. By means of the ring spring 68 the scissor segments 61 and 62 are prevented from parting from each other and urged always so as to open about their support section, 65 and 66. Reference numeral 69 indicates a stopper portion at the base end of each scissor segment body 63. As both stopper portions 69 abut on each other the extent of opening of the scissor segments 61 and 62 is restricted. Reference numeral 70 indicates support holes bored in the convex portion 65 and in a receiving portion 66*a* of the concave portion 66**.

As shown in FIGS. 13 through 16, the plastic housing case 2 has a housing hole H for housing therein the grip scissor body 1. The dimension of the housing hole H is selected so as to accommodate a pair of grip scissors. Reference numerals 72 and 73 indicate slide grooves formed in the upper and lower surfaces of the housing case 2.

Reference numerals 74 and 75 indicate a pair of, front and rear, locking concave portions formed at the front and rear end of one slide groove 72 of the housing case 2.

Figure 14:
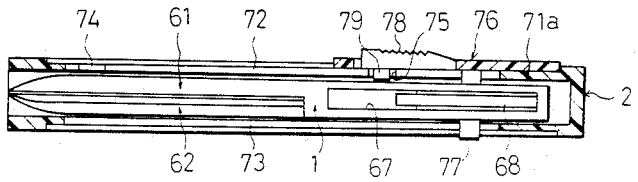
FIG. 14 is a sectional view of FIG. 13.
Figure 16:
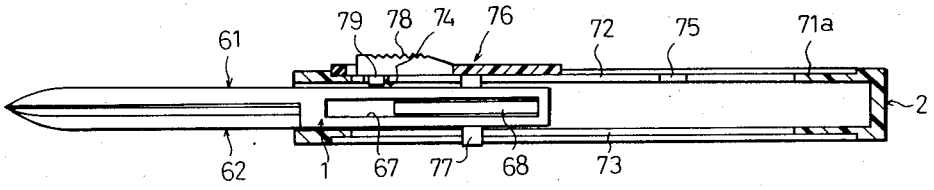
FIG. 16 is a sectional view of FIG. 15.
Figure 17:
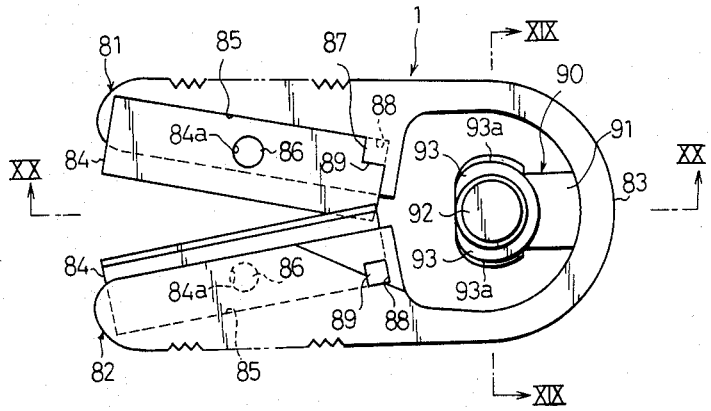
FIG. 17 is a plan view of a grip scissor body which is a fourth embodiment of the present invention.
Figure 18:
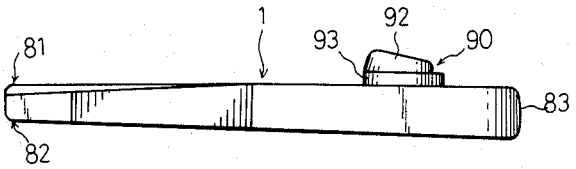
FIG. 18 is a front view of FIG. 17.
Figure 19:
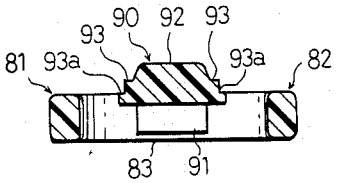
FIG. 19 is a sectional view taken along line XIX—XIX of FIG. 17.
Figure 20:
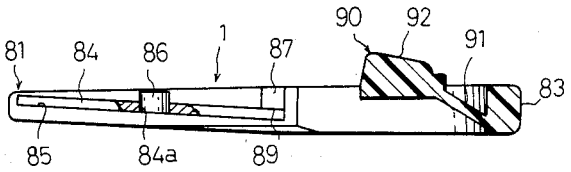
FIG. 20 is a sectional view taken along line XX—XX of FIG. 17.

Reference numeral 76 indicates a slider in the form of a plastic plate, which has a pin 77 located at the rear end of its inner (under) surface, as shown clearly in FIGS. 14 and 16. The slider 76 is put upon the outer side of the slide groove 72 of one side plate **71*a* of the housing case 2. The pin 77 is fitted through the slide groove 72 into both support holes 70 of the support section, 65 and 66 of the grip scissor body 1 inserted inside the housing case 2, so that the housing case 2 and grip scissor body 1 are assembled into the form of a single unit. The tip of the pin 77 of the slider 76 passes through the other slide groove 73. Reference numeral 78 indicates a push/control portion of the slider 76 which has elasticity and nicks in its front section. Reference numeral 79 indicates a locking projection formed on the front inner surface of the push/control portion 78, which is engagable separatably with the front end rear locking concave portions 74 and 75 of the slide groove 72 of the housing case 2. By the locking projection 79 and the pair of locking concave portions 74 and 75 a lock means is made up for locking the grip scissor body 1** inside the housing case 2 in either the housed state or projection state.

According to the thus configured grip scissors, the ring spring 68 is attached so as to surround the support section, 65 and 66, of both scissor segments 61 and 62 at the position ahead thereof; thus, the ring spring 68 does not contact with the palm when in use, the feeling at the time of grasping is better, the grip scissors are controllable very easily, the distance between the support section, 65 and 66 and the base end of the scissor segments is short thereby making short the whole length of the grip scissors, and the grip scissors can easily be miniaturized.

Figure 13:
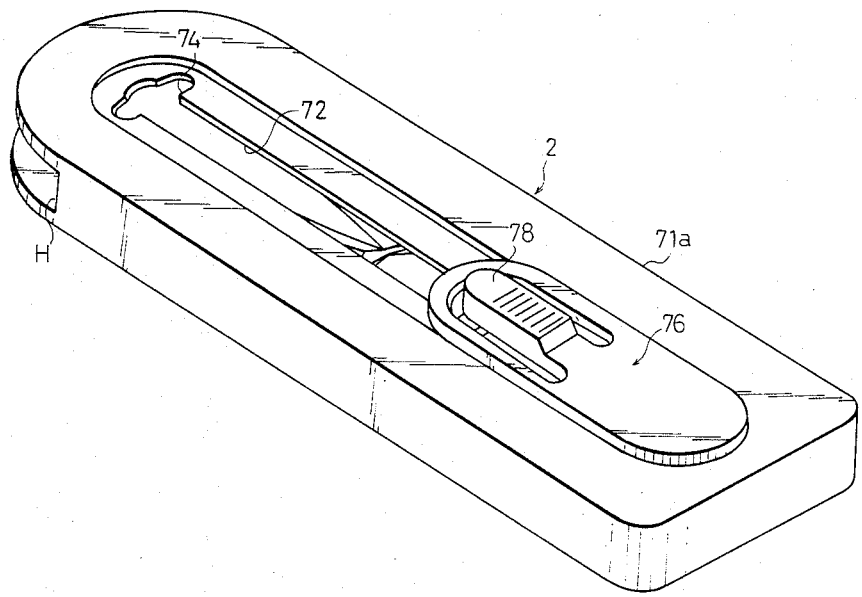
FIG. 13 is a perspective view showing the grip scissors in the nonuse state of FIG. 9.

In the nonuse state the scissor body of the foregoing grip scissors is housed completely inside the housing case 2 as shown in FIGS. 13 and 14. In this housed state, the locking projection 79 at the front end of the push-/control portion 78 of the slider 76 is in engagement with the locking concave portion 75 at the rear end of the slide groove 72, whereby the housed state is locked. Therefore, owing to this engagement the forward movement of the slider 76 is prevented and the grip scissor body 1 can not project easily from the housing case 2.

Figure 15:
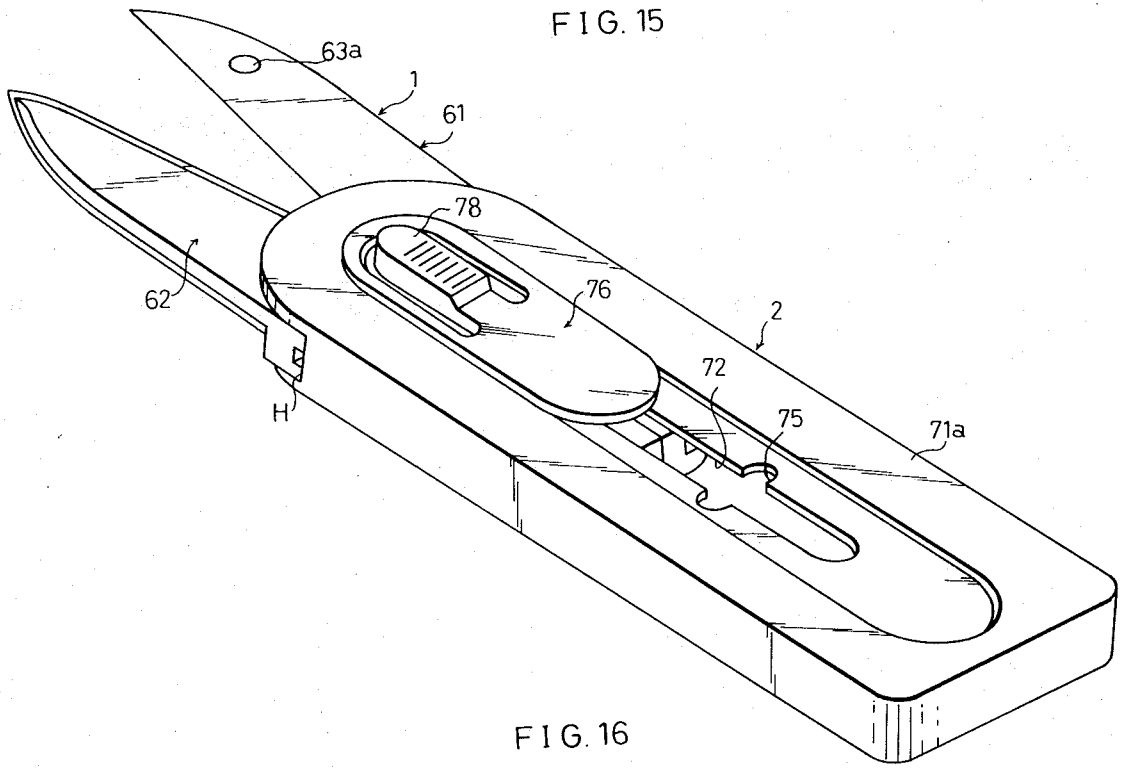
FIG. 15 is a perspective view of the grip scissors in the serviceable state of FIG. 13.

At the time of removing the foregoing housed state and pulling out the grip scissor body 1 from the housing case 2, the push/control portion 78 of the slider 65 is first pushed down to disengage the locking projection 79 from the locking concave portion 75 downward. Then, the slider 76 is moved frontward while moving the locking projection 79 along the slide groove 72. As a result, the grip scissor body 1 projects progressively from the housing case 2 with movement of the slider 76. When the grip scissor body 1 is in the completely projected state, as shown in FIGS. 15 and 16, the locking projection 79 on the inner surface of the push/control portion 78 is engaged with the locking concave portion 74 at the front end of the slide groove 72 so that the projected state is locked.

Accordingly, by the foregoing configuration, during the use of the grip scissors the slider 76 is prevented from moving rearward of itself, and the grip scissor body does not retract into the housing case 2.

In the serviceable state, as the housing case 2 is grasped by the hand, the finger tips of the user touch just the respective scissor segments 61 and 62, so that the housing case 2 serves as the hilt of the grip scissor body 1. Therefore, it is possible to perform the work of cutting paper, for example, under stable conditions.

At the time of housing the grip scissor body 1 into the housing case 2, through the reverse procedure to the above, the push/control portion 78 of the slider 76 is pushed down to disengage the locking projection 79 from the locking concave portion 74. Then, the slider 76 is moved rearward while moving the locking projection 79 along the slide groove 72 of the housing case 2, as a result, the grip scissor body 1 is inserted progressively into the housing case 2 with movement of the slider 76. In the completely inserted state, the push/control portion 78 of the slider 76 returns upward due to its elasticity and the locking projection 79 comes to engagement with the other locking concave portion 75. Therefore, the grip scissor body 1 is housed surely inside the housing case 2.

As described above, by the use of the slider 76 the grip scissor body 1 is made retractable with respect to the housing case 2, so that neither the fingers nor hands need to touch directly the grip scissor body 1 in moving the scissor body; thus, there occurs no danger of injuring either the hands or fingers.

The fourth embodiment of the present invention, which is realized in the form of a pair of grip scissors whose both scissor segments are connected together at their base end portions into the form of a single unit and whose slider is formed integrally on the base end portions, will now be described with reference to FIGS. 17 through 29.

The grip scissor body 1 is first described with reference to FIGS. 17 through 20.

A pair of scissor segments 81 and 82 made of synthetic resin are connected together at their base end portions into the form of a single unit, and the thus connected, coupling section 83 is given some elasticity acting so as to cause the scissor segments 81 and 82 to open/close mutually. The opposed faces in the front sections of both scissor segments 81 and 82 have respective recesses 85 formed therein for mounting blades, and each recess 85 has a projection 86 in its center portion. One corner on the base end side of each recess 85 has a projecting portion 87, and between this projecting portion 87 and a thru-hole 88 bored in each scissor segment 81, 82 in opposition to that projecting portion, a fitting groove 89 is left. Blades 84 each having a positioning hole 84*a* at the center are attached respectively to the recesses 85 of the scissor segments 81 and 82, so that the positioning hole 84*a* is fitted on the projection 86 of the recess 85 and the corner on the base end side of the blade 84 is fitted in the fitting groove 89 of the recess 85.

On the inside of the coupling section 83 of the grip scissor body 1 a slider 90 made also of synthetic resin is formed integrally. Specifically, the slider 90 is composed of a leaf spring portion 91 extending obliquely from the base end-coupling section 83 toward the blades 84, and a push/control portion 92 formed on the top of the leaf spring portion 91. The push/control portion 92 has on its either side a pair of arc-like locking portions 93 formed in a stepped fashion, and stepped portions 93*a* formed along the peripheries of these locking portions 93.

Figure 21:
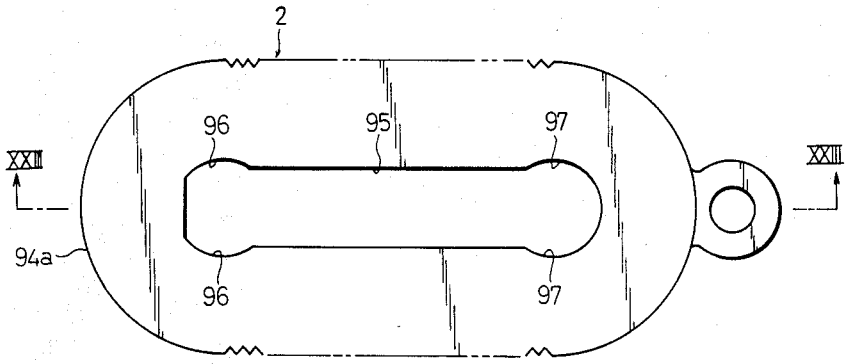
FIG. 21 is a plan view of a housing case for the body of FIG. 17.
Figure 22:
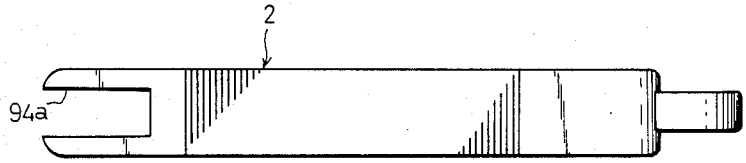
FIG. 22 is a plan view of FIG. 21.
Figure 23:
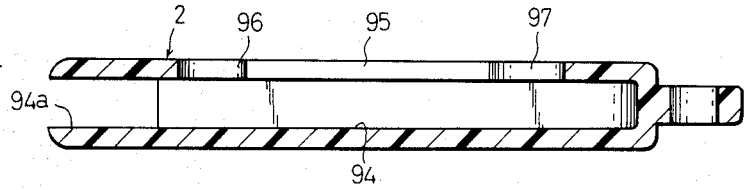
FIG. 23 is a sectional view taken along line XXIII—XXIII of FIG. 21.

Describing the housing case 2 into which the foregoing grip scissor body 1 is assembled, as shown in FIGS. 21 through 23, the upper surface of the housing case 2 having a housing hole 94 has a slide groove 95 extending in the in and out direction, and the front end-side margins and rear end-side margins of the slide groove 95 have arc-like locking concave portions 96 and 97, respectively.

Figure 24:
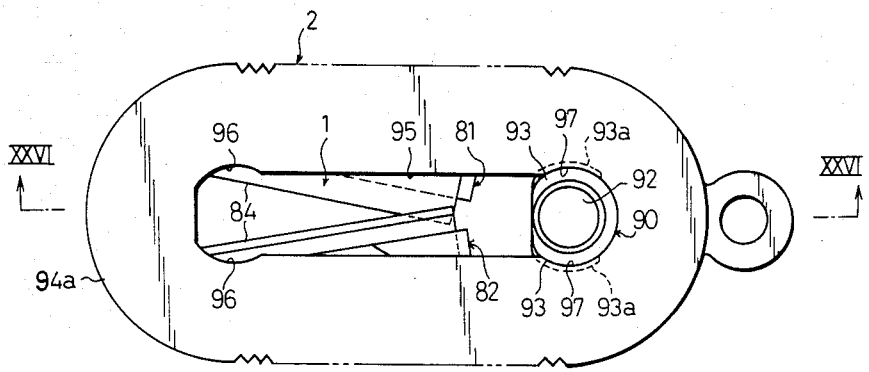
FIG. 24 is a plan view of the grip scissors in the nonuse state of FIG. 17.
Figure 25:
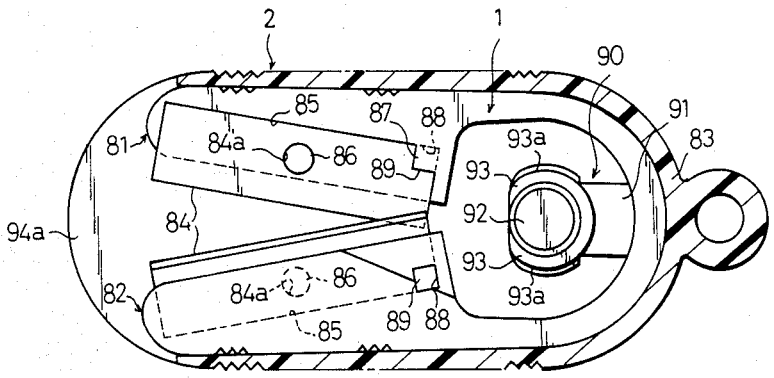
FIG. 25 is a sectional view of FIG. 24.
Figure 26:
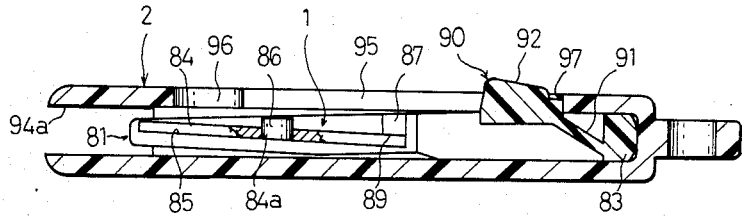
FIG. 26 is a sectional view taken along line XXVI—XXVI of FIG. 24.

To assemble the grip scissor body 1 into the housing case 2 and get the nonuse state illustrated in FIGS. 24 through 26, the coupling section 83 of the grip scissor body 1 is inserted through a gateway 94*a* of the housing hole 94, and after fitting the slider 90 of the coupling section 83 in the slide groove 95 of the housing case 2, it is moved rearward. At this time, the push/control portion 92 of the slider 90 is exposed through the slide groove 95 and both locking portions 93 of the slider 90 move along the marginal inner faces of the slide groove 95. When the blades 84 have completely been inserted together with the grip scissor body 1, the leaf spring portion 91 of the slider 90 returns upward due to its elasticity, both locking portions 93 of the slider 90 come into engagement with both locking concave portions 97 at the rear end of the slide groove 95, and the stepped portions 93*a* of the locking portions 93 are locked by the marginal inner faces of the locking concave portions 97. Accordingly, owing to this locking, the forward movement of the slider 90 is prevented and the grip scissor body 1 is kept housed inside the housing case 2.

Figure 27:
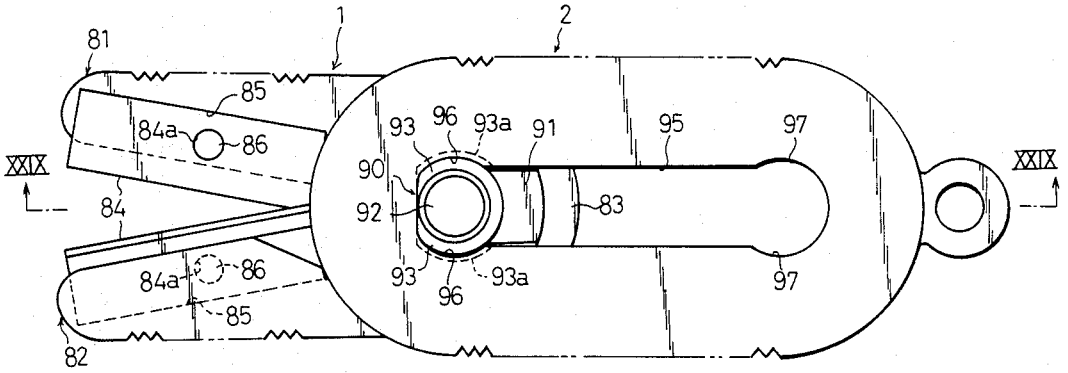
FIG. 27 is a plan view of the grip scissors in the serviceable state of FIG. 24.
Figure 28:
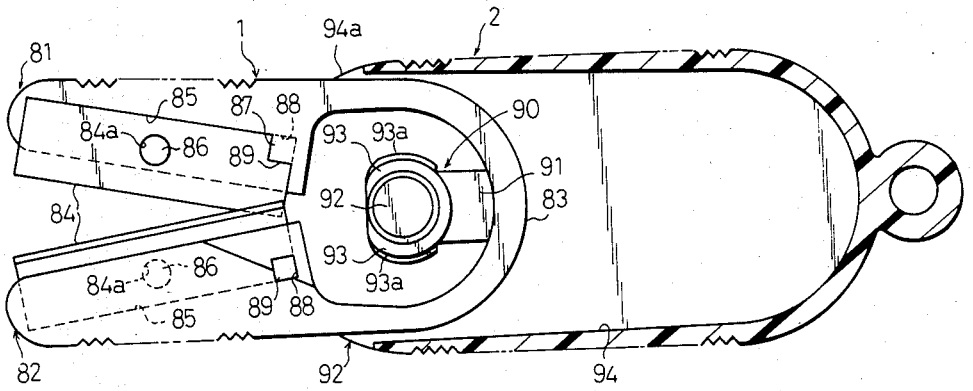
FIG. 28 is a sectional view of FIG. 27.
Figure 29:
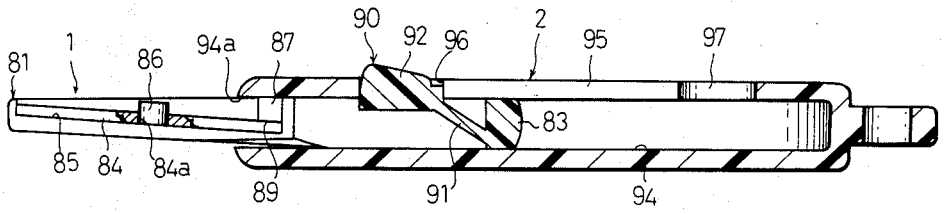
FIG. 29 is a sectional view taken along line XXIX—XXIX of FIG. 27.

To pull out the grip scissor body 1 from the housing case 2 and get the serviceable state illustrated in FIGS. 27 through 29, the push/control portion 92 of the slider 90 is first pushed down to disengage the locking portions 93 from the locking concave portions 97 downward. Then, the slider 90 is moved frontward while moving the push/control portion 92 along the slide groove 95. As a result, the blades 84 of the grip scissor body 1 project progressively from the gateway 94*a* of the housing case 2 with movement of the slider 90. When the blades 84 have completely projected, the leaf spring portion 91 of the slider 90 returns upward due to its elasticity, and the locking portions 93 of the slider 90 come into engagement with the locking concave portions 96 at the front end of the slide groove 95. Accordingly, owing to this engagement, the rearward movement of the slider 90 is prevented and the projected state of the grip scissor body 1 is maintained.

According to this fourth embodiment, particularly, because the grip scissor body 1 is designed so that both scissor segments 81 and 82 are connected together at their base end portions into the form of a single unit and the thus connected-coupling section 83 has the slider 85 formed integrally thereon, the time required for assembly work becomes unnecessary and there is no danger of these parts being lost, different from other configurations wherein both scissor segments, spring and slider formed independent are assembled into the housing case one after another.

Further, the grip scissors according to the present invention can be grasped easily when in use, and when not in use, the grip scissor body can be stored inside the housing case to keep the grip scissors under safety conditions. In addition, the grip scissor body can simply be locked in either the housed state or projected state with respect to the housing case.

As many other embodiments may be made without departing from the spirit and scope of the present invention, it is not intended to have the present invention limited to the specific embodiments thereof except as defined in the appended claims.

What is claimed is:

1. A pair of grip scissors comprising (a) a grip scissor body having a pair of mutually open/close-able scissor segments, said scissor segments having respective stopper portions which, when said scissor segments are moved in mutually opening directions, come into contact with each other to restrict the degree of opening said scissor segments, (b) a housing capable of housing completely therein said grip scissor body in a housed state and of extending said grip scissor body outward to a projected state, said grip scissor body being movable in the lengthwise direction of said housing case, (c) at least one slide groove formed in said housing case and extending in the lengthwise direction thereof, (d) a slide coupled to said grip scissor body and movable reciprocatingly along said slide groove of said housing case, and (e) lock means for automatically locking said grip scissor body when said body is retracted to the housed state or extended to the projected state.

2. A pair of grip scissors according to claim 1, wherein said scissor segments are formed mutually independent and assembled together at their base end portions.

3. A pair of grip scissors according to claim 2, wherein said scissor segments have a spring interposed therebetween for urging said scissor segments in their mutually-opening directions.

4. A pair of grip scissors according to claim 3, wherein said spring is a ring spring, each of said scissor segments has a mounting groove for receiving said ring spring and further a locking portion for locking either end of said ring spring.

5. A pair of grip scissors according to claim 1, wherein said scissor segments have one coupling section for coupling said scissor segments together at their base end portions, said coupling section having elasticity of the direction in which said scissor segments are caused to open/close mutually.

6. A pair of grip scissors according to claim 1, wherein said housing case has a pair of working faces which, at the time of housing said grip scissor body in said case, come into contact with the outer margins of said scissor segments to urge said scissor segments in their mutually-closing directions.

7. A pair of grip scissors according to claim 1, wherein said scissor segments have a pair of locking convex portions formed on their respective outer margins, and said housing case has a pair of locking concave portions which, when said grip scissor body is in the housed state inside said case, engage with said locking convex portions of said scissor segments to maintain said grip scissor body in the housed state.

8. A pair of grip scissors according to claim 1, wherein said slider is composed of a pin, screw and nut provided in portions of said grip scissor body.

9. A pair of grip scissors according to claim 8, wherein said slide groove has in its one end section at least one restricting convex portion which comes into engagement with a portion of said screw of said grip scissor body to maintain said grip scissor body in the projected state from said housing case.

10. A pair of grip scissors according to claim 1, wherein said lock means is composed of said slider, and a pair of locking concave portions formed on either end portion in the lengthwise direction of said slide groove of said housing case and engagable separatably with said slider.

11. A pair of grip scissors according to claim 10, wherein said slider has a push/control portion capable of being pushed elastically downward, said push/control portion having on its under side a locking projection engagable with said pair of locking concave portions.

12. A pair of grip scissors comprising (a) a grip scissor body composed of a pair of mutually open/close-able scissor segments and a coupling section formed integrally with said scissor segments and connecting their respective base end portions together, said scissor segments having a pair of blades, said coupling section having elasticity in the direction in which said scissor segments are caused to open/close mutually, (b) a housing case capable of housing completely therein said grip scissor body in a housed state and of extending said grip scissor body outward to a projected state, said grip scissor body being movable in the lengthwise direction of said housing case, (c) a slide groove formed in one side surface of said housing case and extending in the lengthwise direction thereof, (d) a slider made of synthetic resin formed integrally with said coupling section of said scissor segments and movable reciprocatingly along said slide groove of said housing case, and (e) lock means for automatically locking said grip scissor body when said body is retracted to the housed state or extended to the projected state.

13. A pair of grip scissors according to claim 12, wherein said lock means is composed of said slider, and a pair of locking concave portions formed on either end portion in the lengthwise direction of said slide groove of said housing case and engagable separatably with said slider.

14. A pair of grip scissors according to claim 13, wherein said slider is composed of a leaf spring portion extending obliquely upward, and a push/control portion formed on the top of said leaf spring portion to project from said slide groove and capable of being pushed downward, said push/control portion having on its either side a pair of locking portions engagable with said pair of locking concave portions, and further stepped portions on the outer peripheries of said locking portions.

* * * * *